US007447478B2

(12) United States Patent
Takematsu et al.

(10) Patent No.: US 7,447,478 B2
(45) Date of Patent: Nov. 4, 2008

(54) IMAGE FORMING APPARATUS

(75) Inventors: Koji Takematsu, Abiko (JP); Jiro Shirakata, Kashiwa (JP); Hisashi Otaka, Toride (JP); Kohei Koshida, Toride (JP); Kenichi Manabe, Suzhou (JP); Hideaki Miyazawa, Abiko (JP); Hideaki Kosasa, Abiko (JP); Yuji Yamanaka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 11/432,548

(22) Filed: May 12, 2006

(65) Prior Publication Data

US 2006/0263128 A1 Nov. 23, 2006

(30) Foreign Application Priority Data

May 19, 2005 (JP) ..... 2005-146528

(51) Int. Cl.
*G03G 15/00* (2006.01)

(52) U.S. Cl. ..... 399/388; 399/395; 400/579; 400/645.4; 271/226; 271/248

(58) Field of Classification Search ..... 399/395, 399/388; 271/226, 248; 400/579, 645.4
See application file for complete search history.

(56) References Cited

U.S. PATENT DOCUMENTS

| | | | | |
|---|---|---|---|---|
| 4,712,906 | A * | 12/1987 | Bothner et al. | 399/303 |
| 2005/0128536 | A1 | 6/2005 | Yamanaka et al. | 358/488 |
| 2005/0156373 | A1 * | 7/2005 | Konagaya | 271/226 |
| 2006/0051116 | A1 | 3/2006 | Koshida | 399/68 |
| 2006/0120744 | A1 | 6/2006 | Shirakata et al. | 399/68 |
| 2006/0222386 | A1 | 10/2006 | Koshida et al. | 399/44 |
| 2006/0222394 | A1 | 10/2006 | Koshida | 399/68 |

FOREIGN PATENT DOCUMENTS

JP 2002-244449 8/2002

* cited by examiner

*Primary Examiner*—Ren Yan
*Assistant Examiner*—Andy L Pham
(74) *Attorney, Agent, or Firm*—Fitzpatrick, Cella, Harper & Scinto

(57) ABSTRACT

An image forming member has a first sheet conveying member arranged at upstream side of a sheet conveying path of a sheet material, a second sheet conveying member arranged at downstream side of said sheet conveying path, a guide member which is provided between the first and the second sheet conveying members and guides the sheet material and a movable portion which is provided in the guide member and executes front-and-far-side adjustment of the sheet material by moving a portion against which the tip of sheet material is abutted in parallel to a sheet width direction perpendicular to a conveying direction.

5 Claims, 13 Drawing Sheets

AB+AC=L(GUIDE PATH LENGTH)

IMAGE FORMING APPARATUS

BACKGROUND OF THE INVENTION

1. Field of the Invention

The present invention relates to an image forming apparatus, such as a copying machine, a laser beam printer, a laser facsimile machine, and a multifunction machine thereof, by which an image is formed on a sheet material.

2. Description of the Related Art

A number of image forming apparatuses such as a color copying machine and a color laser beam printer, by which an image is formed according to an electrophotographic type or an electrostatic recording type, adopt an intermediate transfer type in which an image forming apparatus has a configuration provided with a photosensitive drum and an intermediate transfer belt as an image bearing member. According to the intermediate transfer type, an image born on a photosensitive drum is transferred (primary transfer) onto the surface of an intermediate transfer belt, and the images on the intermediate transfer belt are transferred at a time onto a sheet material as a recording medium (secondary transfer), as disclosed in, for example, Japanese Patent Application Laid-Open No. 2002-244449. A number of image forming apparatuses adopting the intermediate transfer belt type have been proposed.

FIG. 8 shows a structure example of a secondary transfer portion including an intermediate transfer belt 3, and the like. Images formed on a photosensitive drum (not shown) as an image bearing member are transferred onto the intermediate transfer belt 3. The images transferred on the intermediate transfer belt 3 are transferred at a time onto a sheet of recording paper (hereinafter, called a sheet material S as a material onto which an image is transferred) conveyed from between resistration rollers 7 and 8. Immediately after the sheet material S is fed out through the pair of resistration rollers 7 and 8, the tip of the sheet material S is guided along both of side walls 1 and 2 (hereinafter, called secondary transfer feeding guides 1 and 2), which form a guide path (guide passage), toward between a pair of rollers 4 and 5 in the secondary transfer portion. The secondary transfer roller 4 as one of the roller pair forms one of a plurality of rollers which tightly stretch the intermediate transfer belt 3 for winding.

In the secondary transfer portion, the sheet material S is guided along the guide path formed with the secondary transfer feeding guides 1 and 2, and the images on the intermediate transfer belt 3 are transferred at a time onto the sheet material S, while the sheet material S is being pressed between the secondary transfer rollers 4 and 5, when the sheet material S is fed out through the pair of resistration rollers 7 and 8 which rotate by rotating power received from a motor (not shown) as a driving source. In this case, the resistration roller 8 as one of the roller pair, together with a roller bearing 9, is energized with a pressing spring 11, and is pressed against the resistration roller 7 as the other of the roller pair, and the secondary transfer roller 5 as one of the roller pair, together with a bearing arm 6, is energized with a pressing spring 10, and is pressed against the secondary transfer roller 4 as the other of the roller pair.

FIG. 9A and FIG. 9B are a schematic view of the behavior of the sheet material S just before the sheet material S is fed to between the secondary transfer rollers 4 and 5. The tip of the sheet material S fed out from between the resistration rollers 7 and 8 is guided as shown in FIG. 9A while being abutted against the secondary transfer feeding guide 2 in one of sidewalls, and is bent by being abutted against an abutment portion A (hereinafter, called an abutment point) which is a turning portion of the secondary transfer feeding guide 1 of the other sidewall. Subsequently, the sheet material S, first from the tip, enters into the secondary transfer portion of the pair of the secondary transfer rollers 4 and 5, as shown in FIG. 9B, for secondary transfer of the images on the intermediate transfer belt 3.

Following FIG. 9A and FIG. 9B, FIG. 10A and FIG. 10B also are a schematic view of the behavior of the sheet material S during being conveyed. When the rotational speeds V1 of the secondary transfer rollers 4 and 5 are larger and faster than the rotational speeds V2 of the resistration rollers 7 and 8, that is, in the case of V1>V2, the sheet material S is guided along the secondary transfer feeding guide 1 while being abutted thereagainst as shown in FIG, 10A. Conversely, in the case of V1<V2, the sheet material S is guided along the secondary transfer feeding guide 2 while being abutted thereagainst as shown in FIG. 10B.

Incidentally, the behavior of the sheet material S just before the sheet material S is fed into the secondary transfer portion has been shown as a general example in FIG. 8 through FIG. 10B. But the secondary transfer portion in the above embodiments has had the following structural problems which should be solved.

As shown in FIG. 8, the secondary transfer feeding guide 1 is integrally molded into a part of a conveying path frame 12. There are some cases in which, as shown in FIG. 11 of the above-described secondary transfer feeding guide 1 seen from above, a displacement is caused in the positioning of the conveying path frame 12 as a base, and the secondary transfer feeding guide 1 is positioned not parallel to the direction of the sheet width intersecting perpendicularly to the conveying direction of the sheet material S, but inclined at an angle $\alpha$ to cause a difference in the conveying direction, that is, a front and back difference (hereinafter, "front and back" is expressed as "front and far-side") between both the ends 1*a* and 1*b* of the guide. The above front and far-side difference of the guide causes an abnormality, such as a displacement, of an image for which secondary transfer onto the sheet material S is executed.

Furthermore, the conveying path frame 12 is set with the maximum dimensional tolerance between the front and the far-side at positioning in some cases. Then, there is caused a front and far-side difference between the both sides, that is, for the width of a guide path in a conveying segment between the resistration rollers 7 and 8, and the secondary transfer roller 4 and 5. Thereby, timing at which the sheet material S enters into a nip portion between the secondary transfer rollers 4 and 5 is different from each other at the both sides of the tip of the sheet material S, and there is caused a phenomenon in which an image is transferred in a state in which the image is inclined in the front and far-side direction relative to the sheet material S. Accordingly, image magnifications are different from each other between the front and the far-side to cause an abnormality in an image.

SUMMARY OF THE INVENTION

Considering the above circumstances, an object of the present invention is to provide an image forming apparatus by which, by adjusting the feeding of a sheet material during conveying in such a way that there is caused no displacement between feeding amounts at the both ends in the sheet-width direction, a high-quality image can be printed without causing an abnormality, such as a displacement, in an image transferred on the sheet material.

In order to achieve the above-described object, an typical image forming apparatus according to the present invention is provided with: a first sheet conveying member arranged at upstream side of a sheet conveying path;

a second sheet conveying member arranged at downstream side of said sheet conveying path;

a guide member which is provided between said first and said second sheet conveying members and guides a sheet material conveyed from said first sheet conveying member to said second sheet conveying member; and a movable portion which is movably provided in said guide member, wherein said movable portion has an abutment portion against which the sheet material conveyed toward to said second sheet conveying member by said first sheet conveying member is abutted, and said abutment portion is adjusted by movement of said movable portion so that the tip of the sheet material guided by said guide member is in parallel to a sheet width direction perpendicular to a conveying direction.

DESCRIPTION OF THE EMBODIMENTS

Figure 8:
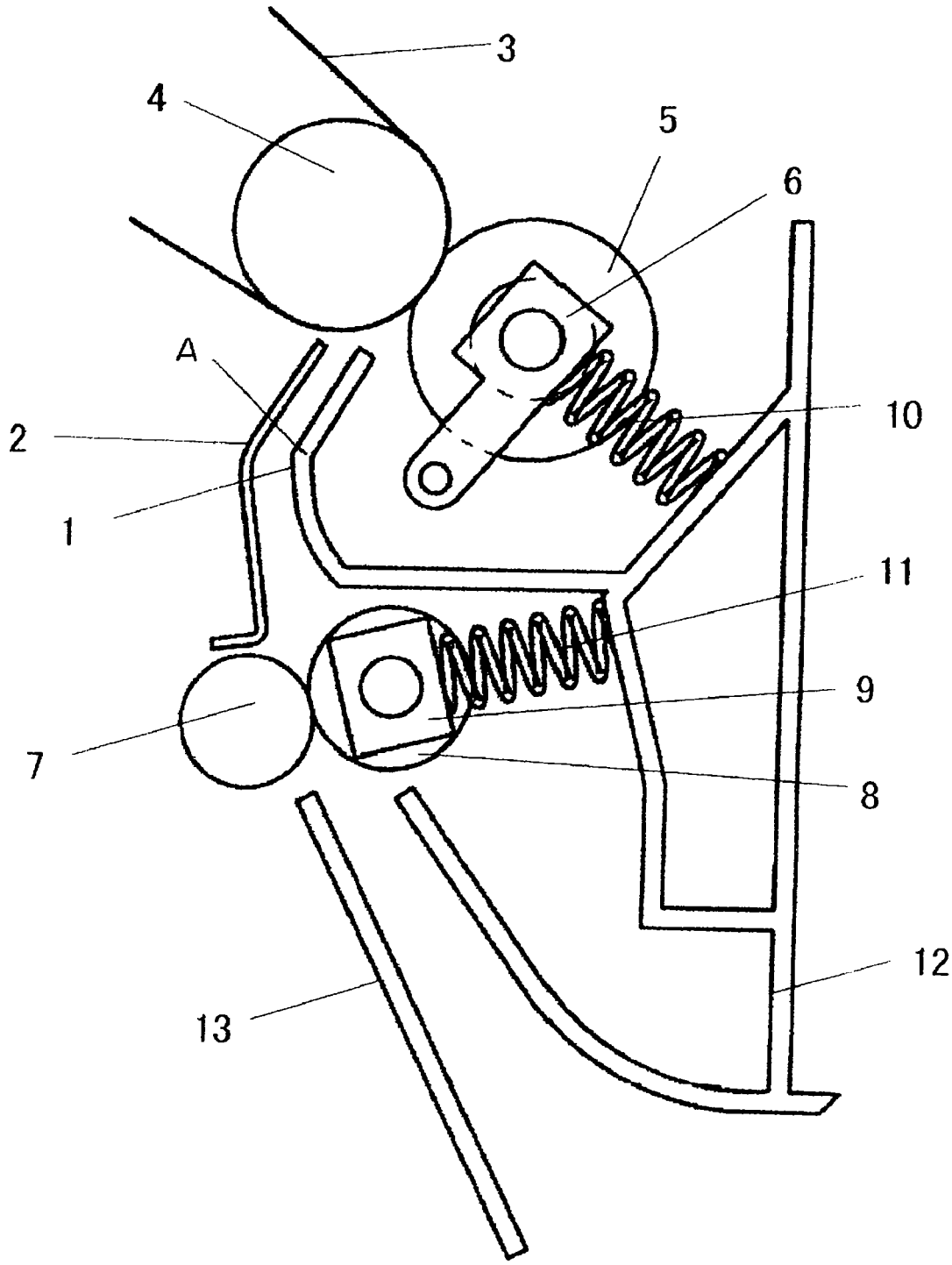
FIG. 8 PRIOR ART
FIG. 8 is a sectional view showing a configuration of a conventional sheet guide path.
Figure 9A:
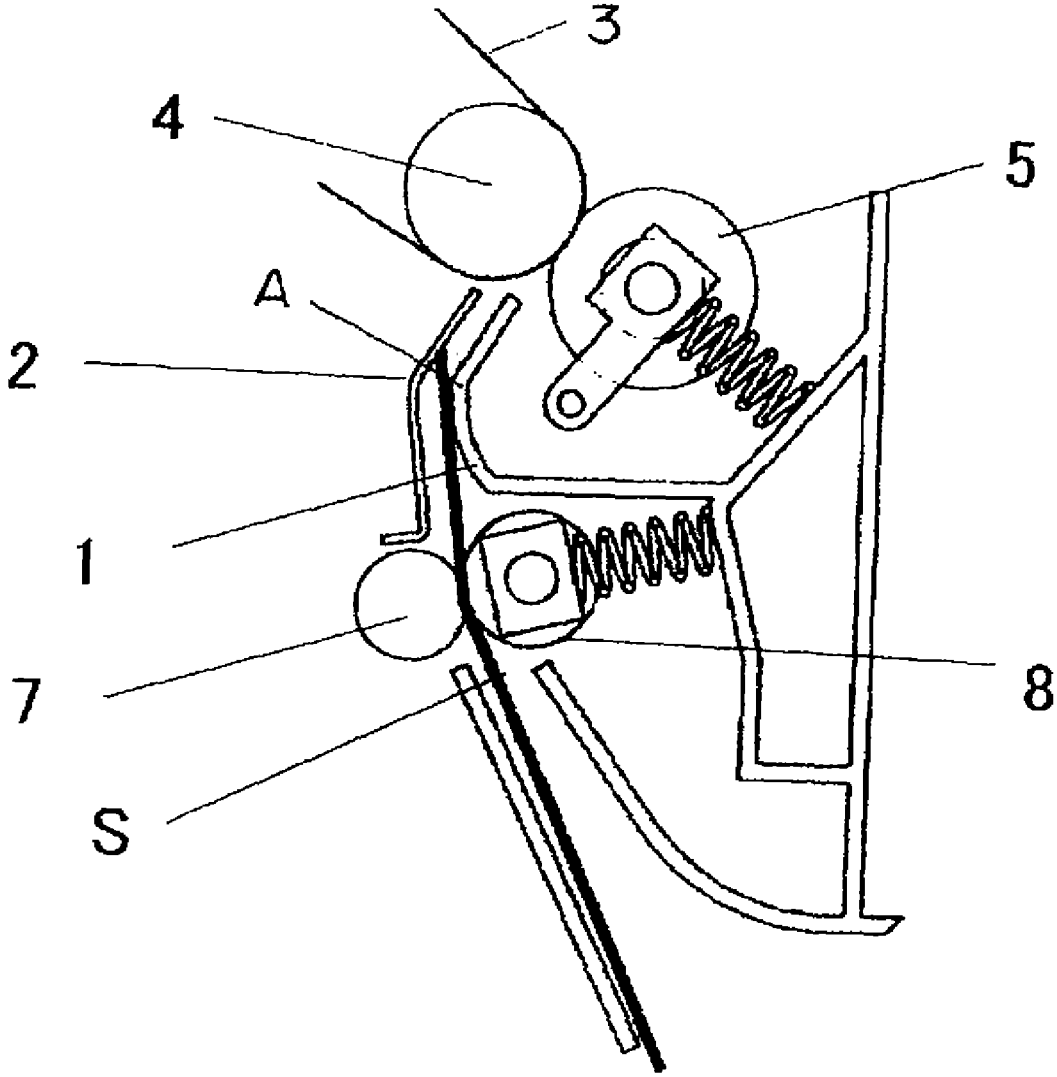
FIG. 9A PRIOR ART
FIG. 9A is a sectional view showing a conveying aspect of a sheet material in one of a secondary transfer feeding guides according to a conventional sheet guide path.
Figure 9B:
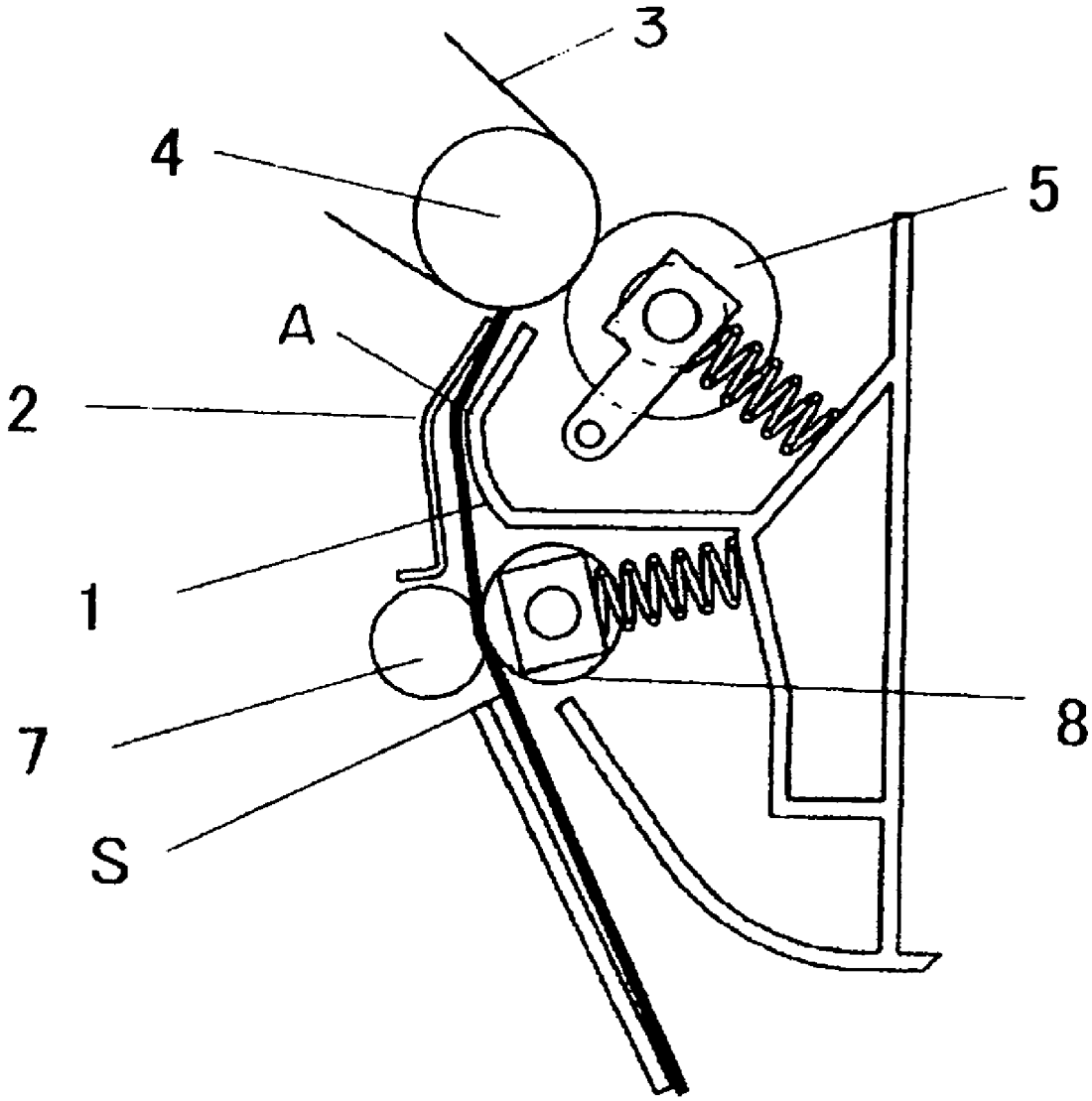
FIG. 9B is a sectional view showing a conveying aspect of the sheet material in one of the secondary transfer feeding guides according to the conventional sheet guide path.
Figure 10A:
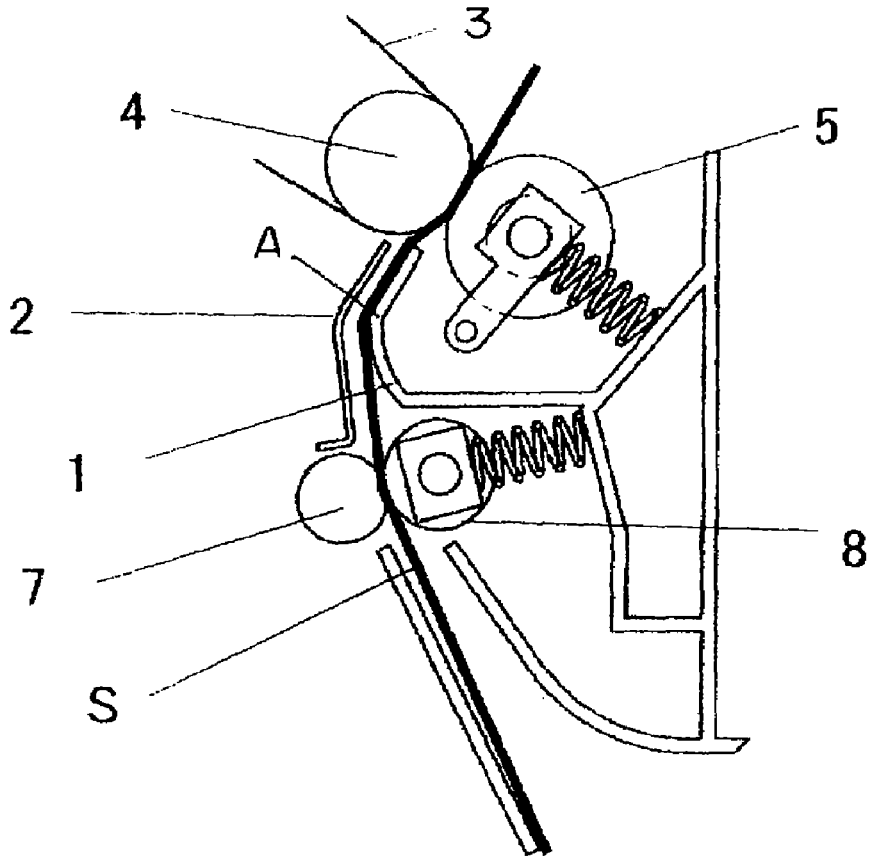
FIG. 10A PRIOR ART
FIG. 10A is a sectional view showing a conveying aspect of the sheet material in the other of the secondary transfer feeding guide according to the conventional sheet guide path.
Figure 10B:
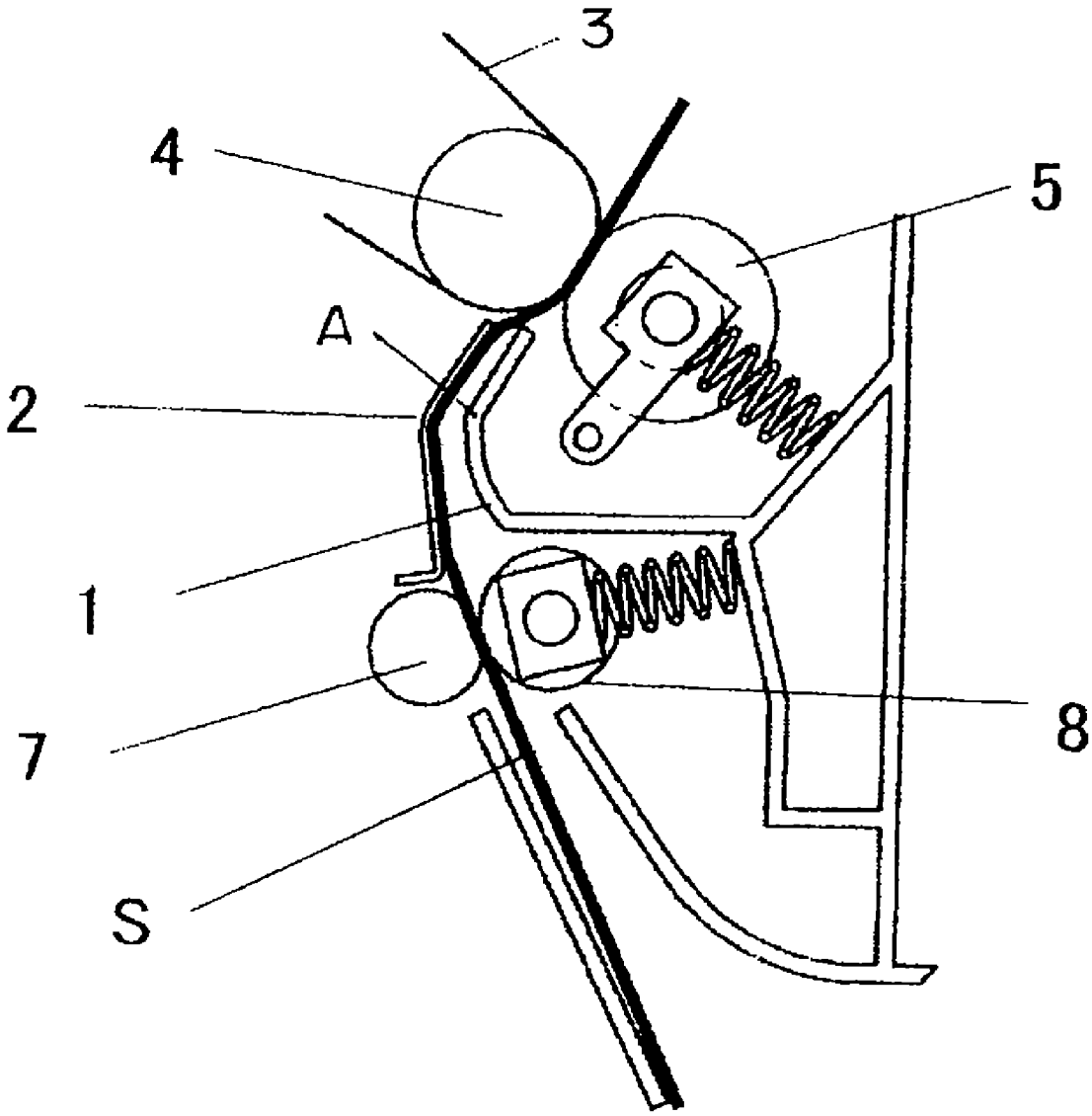
FIG. 10B PRIOR ART
FIG. 10B is a sectional view showing a conveying aspect of the sheet material in the other of the secondary transfer feeding guide according to the conventional sheet guide path.
Figure 11:
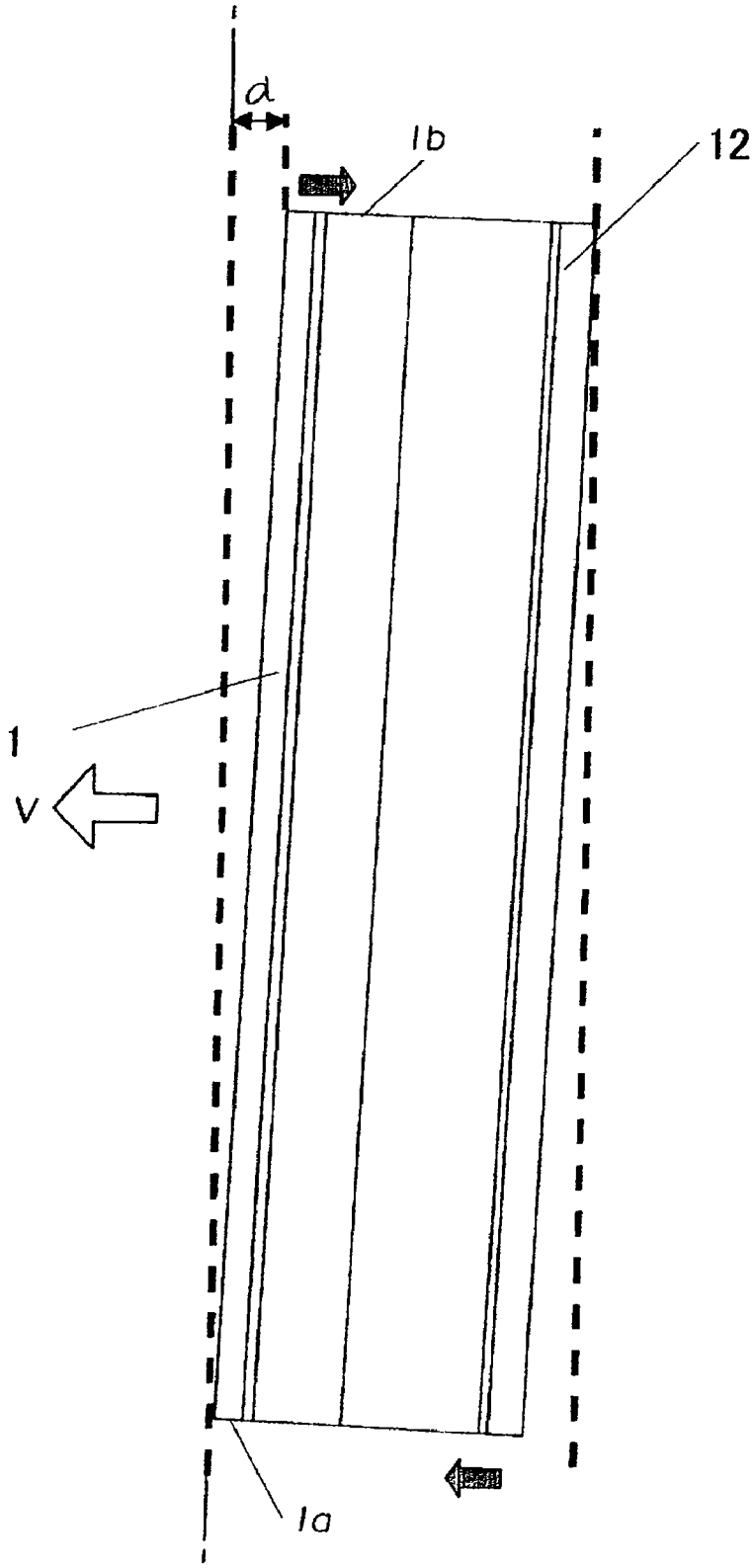
FIG. 11 PRIOR ART
FIG. 11 is a plan view showing an aspect in which a front and far-side difference is caused in the conventional sheet guide path.

Hereinafter, preferred embodiments of an image forming apparatus according to the present invention will be explained in detail, referring to drawings. Here, members similar to those previously described with reference to the structure examples shown in FIG. 8 through FIG. 10 are denoted by the same reference numerals for easy understanding of the present embodiment.

(Explanation of Image Forming Apparatus)

Figure 1:
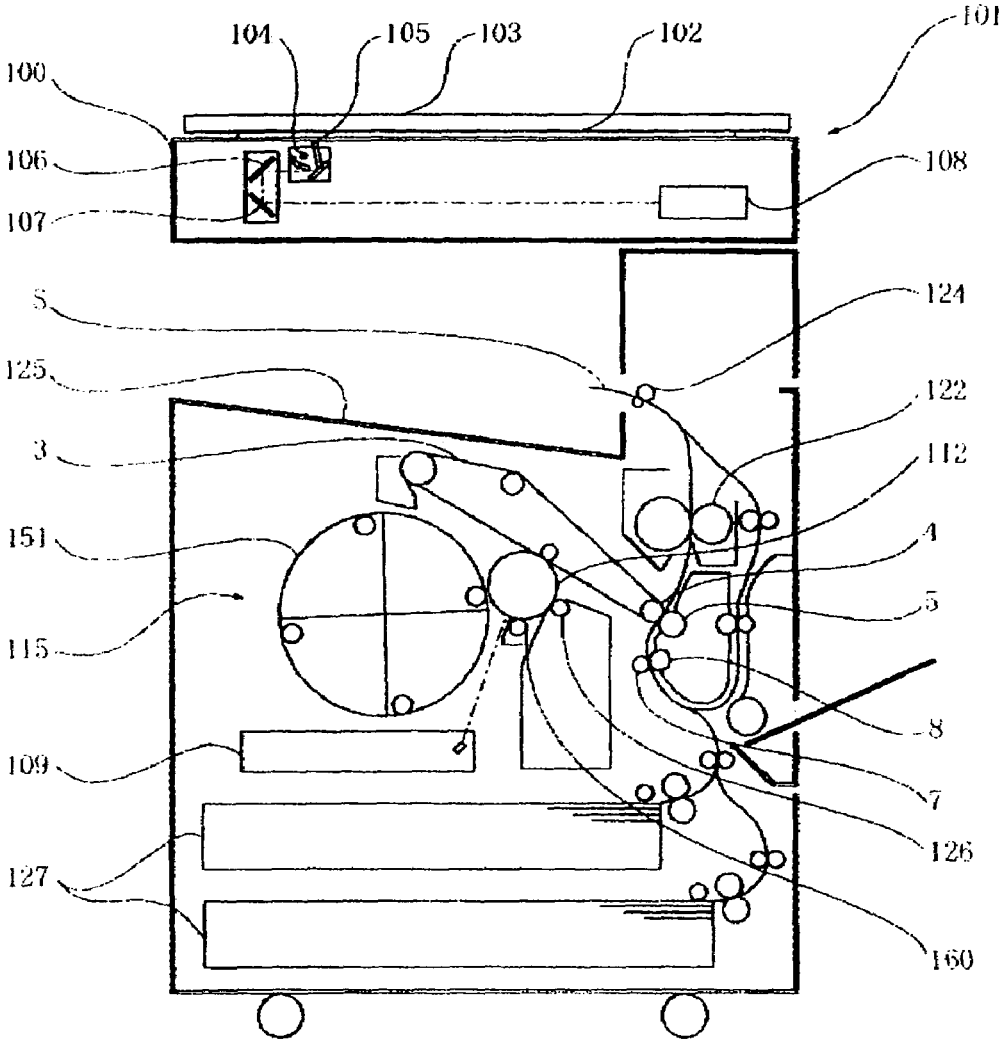
FIG. 1 is a sectional view showing an image forming apparatus according to one embodiment of the present invention.

In the first place, FIG. 1 shows the image forming apparatus according to the present embodiment in which an original base plate 102 including a transparent glass plate is fixed and provided on the upper portion of a main body 101. An original application plate 103 is a member which presses and fixed an original 100 mounted at a predetermined position of the original base plate 102 with the image surface directed downward. An optical system is provided under the original base plate 102, wherein the system has a lamp 104 illuminating the original 100, and includes reflecting mirrors 105, 106, and 107, through which an optical image on the illuminated original 100 is led to an image processing unit 108. Here, the lamp 104, and the reflecting mirrors 105, 106, and 107 are moved at a predetermined speed for scanning the original 100.

An image formation device 160 has a configuration provided with a photosensitive drum 1 as an image bearing member, a charging roller 8 for uniformly charging the surface of the photosensitive drum 1, a drum cartridge 50 including a cleaner 9 which removes toners remained in the photosensitive drum 1 after transferring of a toner image, and the like, a rotary developing unit 151 forming a toner image on the photosensitive drum 1, an intermediate transfer belt unit 60, onto which the toner image developed on the surface of the photosensitive drum 1 is transferred, and the like.

The photosensitive drum 1 has a configuration in which the optical image is irradiated from a laser unit 109 onto the surface of the photosensitive drum 1 charged by the charging roller 8, and an electrostatic latent image formed with the optical image is developed and is transferred onto the intermediate transfer belt 3. The toner images on the intermediate transfer belt 3 are transferred at a time onto a sheet material S as a material, onto which an image is transferred, in the secondary transfer portion by one pair of the secondary transfer rollers 4 and 5 which are facing with each other, holding the intermediate transfer belt 3 therebetween. The sheet material S is supplied from a sheet cassette 127.

Figure 2:
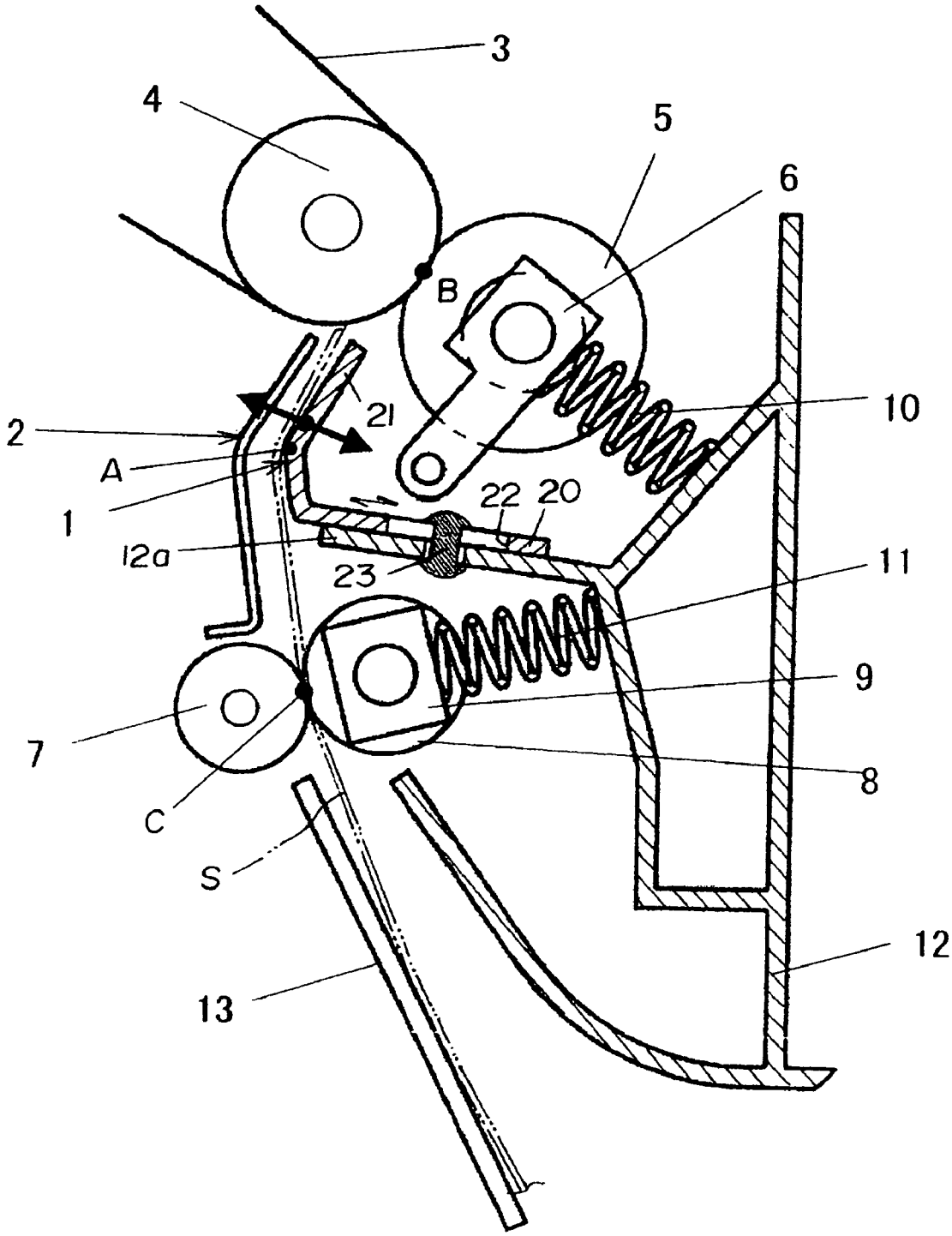
FIG. 2 is a sectional view showing a configuration of a sheet guide path in a conveying system of a secondary transfer portion as a principal portion according to the first embodiment.

Here, as shown in FIG. 2 and the subsequent drawings, one pair of resistration rollers 7 and 8 facing with each other are arranged at upstream side of the above-described secondary transfer rollers 4 and 5 on a sheet conveying path. The resistration rollers 7 and 8 are a first sheet conveying member in the present invention, and the secondary transfer rollers 4 and 5 arranged at downstream side of the above-described rollers 7 and 8 form a second sheet conveying member. The point of the first embodiment according to the present invention is in which, on the assumption that a distance between the roller axes of the first and the second sheet conveying members is a guide path length, the sheet material S is fed into the secondary transfer rollers 4 and 5 as the second sheet conveying member after the attitude of the sheet material S is adjusted in a section between the first and the second sheet conveying members in such a way that the front and far-side error is not caused and the sheet material S is conveyed.

In FIG. 1, a fixing device 122 by which the toner image on the sheet material S is fixed as a permanent image, and a discharge roller pair 124 through which the sheet material S onto which the toner image is fixed is discharged from the main body 101 of the image forming apparatus are sequentially disposed at downstream side of the image formation device 160 in the sheet conveying direction. A discharge portion 125 with a tray shape is provided at the outer side of the main body 101 of the image forming apparatus, wherein the portion 125 receives the sheet material S discharged through the discharge roller pair 124.

(Explanation of Sheet Conveying Apparatus)

FIG. 2 is a sectional view showing a configuration of a guide path (passage) which guides a sheet material S for conveying in a sheet conveying system including the secondary transfer portion in the present embodiment. The secondary transfer feeding guide 1, among the secondary transfer feeding guides (guide members) 1 and 2 as the principal portion, includes a support plate 12*a* integrally molded into a part of the conveying path frame 12, and a sheet correcting plate 20 (movable portion) which can slide and move to the support plate 12*a*. The sheet correcting plate 20 has a correcting portion 21 a part of which is bent and molded, and a sheet passage as a guide path is formed between the portion 21 and the secondary transfer feeding guide 2. A passage turning portion is the abutment portion A (abutment point) And sheet material s is bent by being abutted against an abutment portion A.

Figure 4:
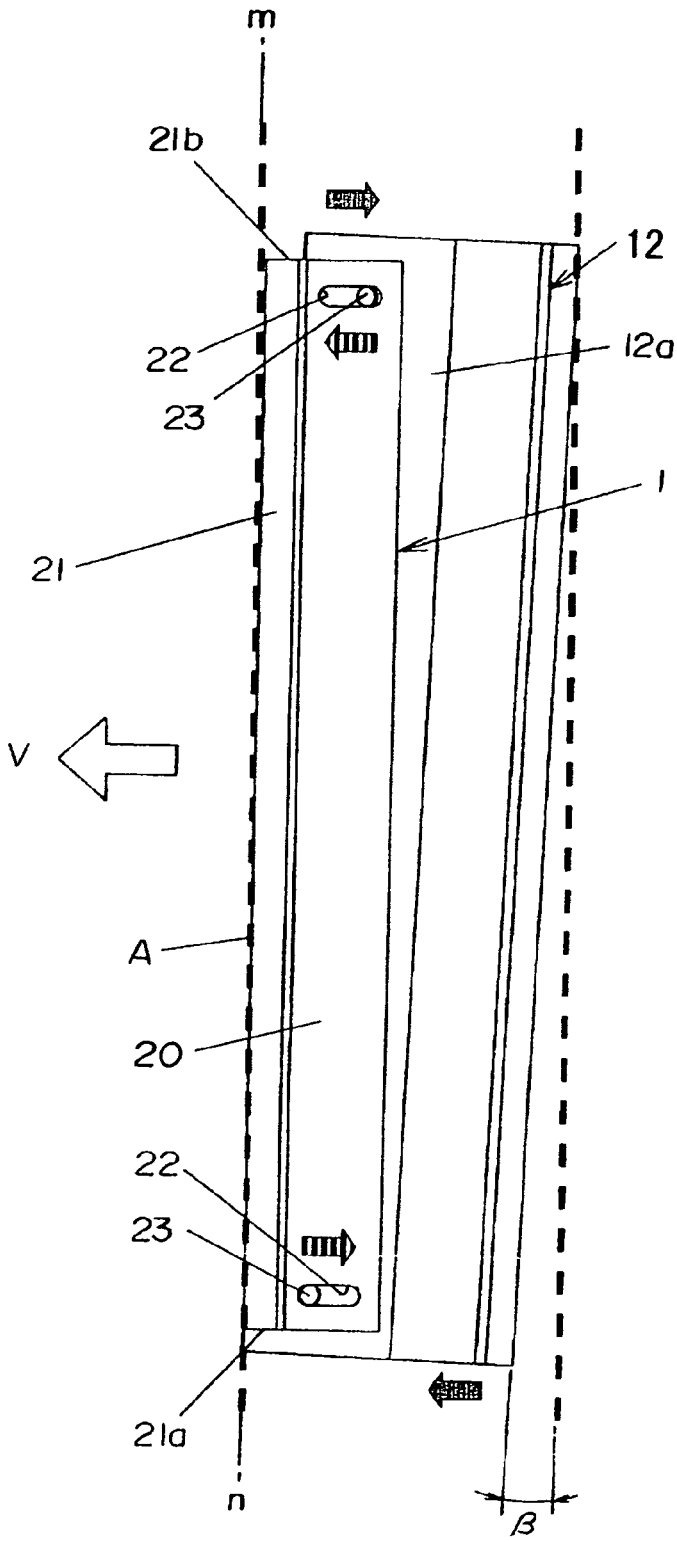
FIG. 4 is a plan view corresponding to FIG. 2 seen from above in the first embodiment.

FIG. 4 is a plan view of the sheet correcting plate 20 corresponding to FIG. 2. That is, slide holes 22 with a shape of a long groove are provided at both the ends of the plate of the sheet correcting plate 20, respectively, and the plate can slide and move to the support plate 12*a* with a slide pin 23 which extends through the plate from the support plate 12*a*. The above sliding and moving of the sheet correcting plate 20 causes the back and forth movement of the correcting portion 21 to the guide path, and the attitude of the sheet material S is corrected by the back and forth movement for correcting adjustment of the front and far-side difference while the sheet material S, which is being conveyed, is guided toward the pair of the secondary transfer rollers 4 and 5 (first sheet conveying member). Even when the support plate 12*a* integrated into the conveying path frame 12 has the front and far-side difference and the both ends of the plate are inclined to each other by an angle β in FIG. 2, adjustment of the plate 12*a* is executed in such a way that the front and far-side difference, that is, back and forth movement of the both (right and left) ends 21*a* and 21*b* of the correcting portion 21 to the plate 12*a* is removed. That is, the sheet correcting plate 20 is an adjusting mechanism by which the front and far-side difference is removed at the tip of the sheet material S, which is being conveyed, by arranging the front of the correcting portion 21 flush with a line mn intersecting perpendicularly to the conveying direction of the arrow V shown in FIG. 4. That is, the tip of the sheet material s guided by said the correcting portion 21 is in parallel to a sheet width direction perpendicular to the conveying direction.

Figure 3:
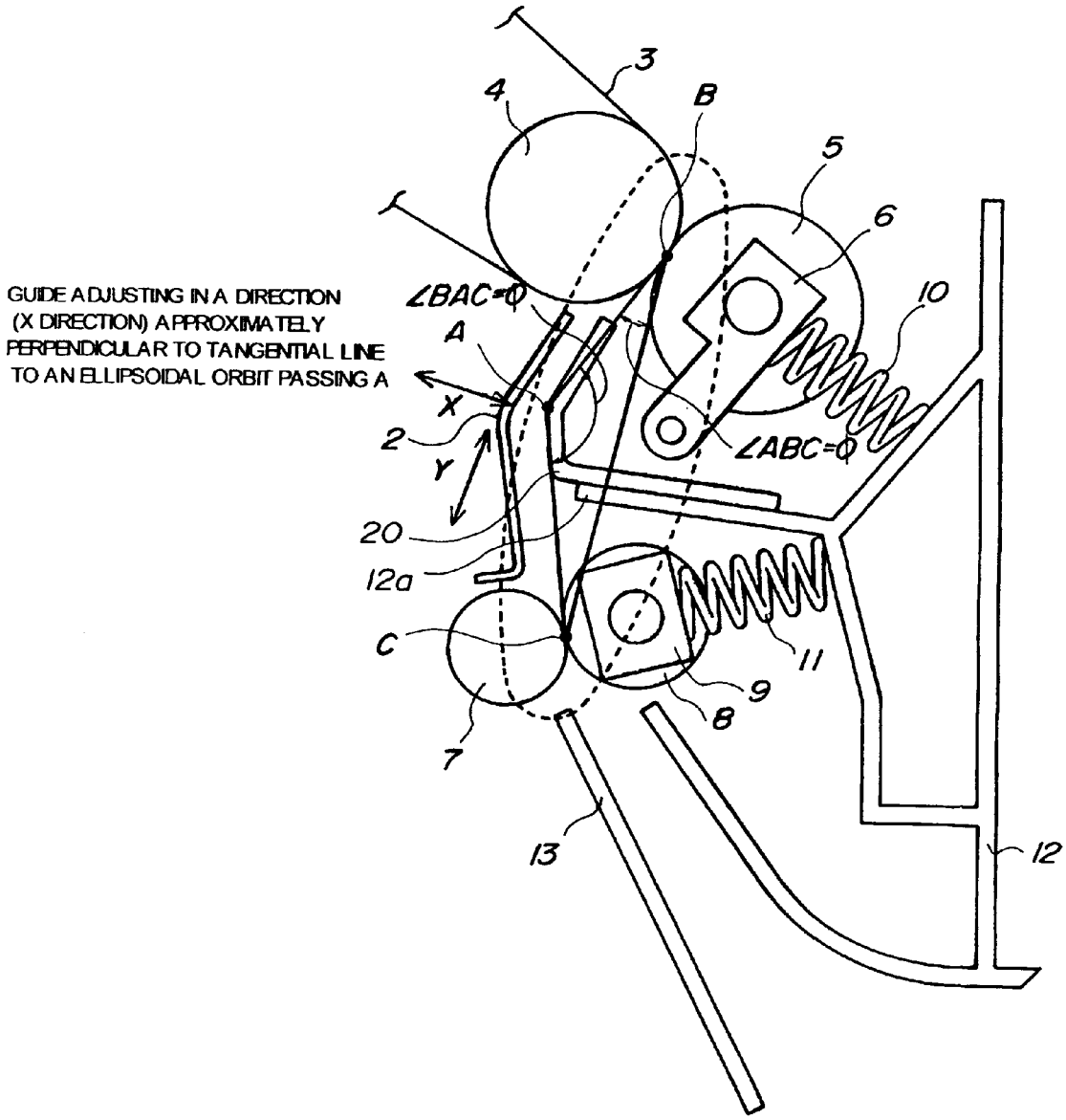
FIG. 3 is a sectional view schematically showing fine adjusting operation against a front and far-side difference in the first embodiment.

FIG. 3 is a schematic view showing operations by which the both ends 21*a* and 21*b* of the secondary transfer feeding guide 1 are moved as described above for fine adjustment in such a way that the front and far-side difference is removed.

That is, assuming that, in the above-described sheet correcting plate 20 forming the secondary transfer feeding guide 1, an abutment portion provided in the correcting portion 21 is A, a nip portion of the pair of the secondary transfer rollers 4 and 5 is B, and a nip portion of the pair of the registration rollers 7 and 8 (second sheet conveying member) is C, the point A exists on an ellipsoidal orbit P with focal points of the point B and the point C. That is, AB+AC obtained by adding the distances from the point A to the focal points B and C corresponds to a guide path length L meaning a distance in which the sheet material S is guided in the conveying section between the secondary transfer rollers 4 and 5 and the registration rollers 7 and 8.

Even when the sheet correcting plate 20, that is, the correcting portion 21 is moved for adjustment in the tangential direction (in the direction of the arrow Y shown in the drawing) to the ellipsoidal orbit P passing the abutment portion A, the guide path length L (=AB+AC) moves approximately on an ellipsoidal orbit. Thereby, when the correcting portion 21 is moved in the direction (in the direction of the arrow X shown in the drawing) approximately perpendicular to the tangential direction to the ellipsoidal orbit P passing the abutment portion A under a state that the guide path length L is not changed, the sensitivity for the change in the guide path length L becomes the highest.

Thereby, the whole of the secondary transfer feeding guide 1 is moved for adjustment in the direction (in the direction of the arrow X shown in the drawing) approximately perpendicular to the tangential direction to the ellipsoidal orbit P passing the abutment portion A, and fine adjustment is executed, in such a way that the front and far-side difference of the guide path length L is removed. Accordingly, an image shift at the tip portion of the sheet material S is prevented, and generation of an image with an abnormal image magnification is effectively suppressed. Incidentally, assuming that a bending angle ∠BAC at the abutment portion A is θ, and an incident angle ∠ABC to the secondary transfer portion is ϕ, a preferable θ is, for example, 140 degrees.

Moreover, when the hitting portion (not shown) of the conveying path frame 12 is abutted within a maximum tolerance, or even when the dimensional tolerance of a portion for positioning of the conveying path frame 12 is swung to the maximum, the front and far-side difference of the guide path length L is not caused by fine adjustment of the secondary transfer feeding guide 1 as shown in FIG. 4. Accordingly, the front and far-side shift of an image at the tip portion of the sheet material S, or generation of an image with an image magnification may be prevented by being controlled the front and far-side difference of the guide path length L.

Figure 5:
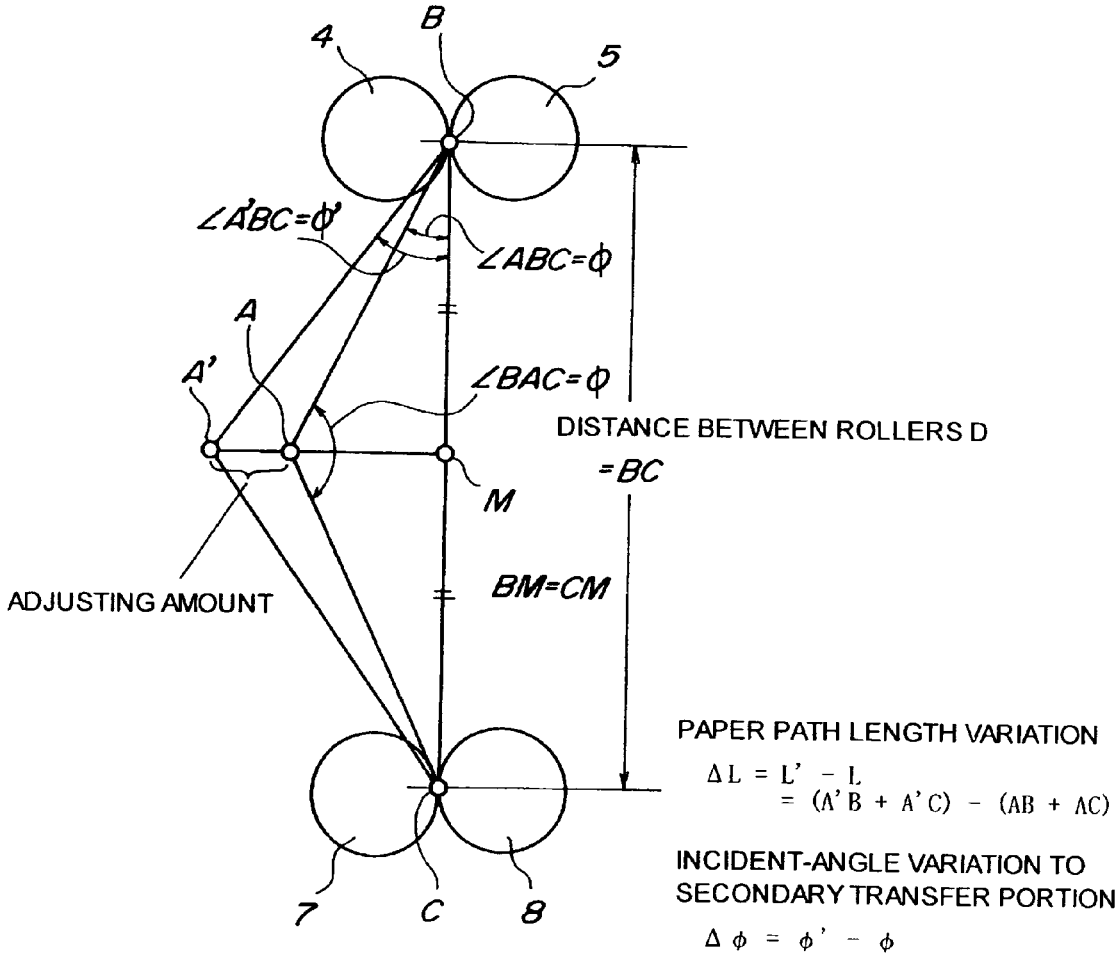
FIG. 5 is a schematic view of a trigonometric-function model showing a correlation among three points on a guide path in the first embodiment.

Here, a relation among a bending angle θ at the abutment portion A of the secondary transfer feeding guide 1, a guide path length L, and an incident angle ϕ to the secondary transfer portion may be obtained from a trigonometric-function model, as shown in FIG. 5.

Now, a guide path variation ΔL by guide adjustment, and an incident angle Δϕ to the secondary transfer portion bye guide adjustment are expressed in the following formulae (1) and (2), respectively, for simplification of the model, when an adjusting amount is assumed to be Y at adjusting the abutment portion A to the portion A' on condition of meeting a similar triangle figure ΔABM≡ΔACM at a point M.

$$\Delta L = L' - L = \{d - \sin(\theta/2)\} - \{d - \sin(\theta'/2)\} \quad (1)$$

$$\Delta\phi = \phi' - \phi = (\theta/2) - (\theta'/2) \quad (2)$$

Figure 6:
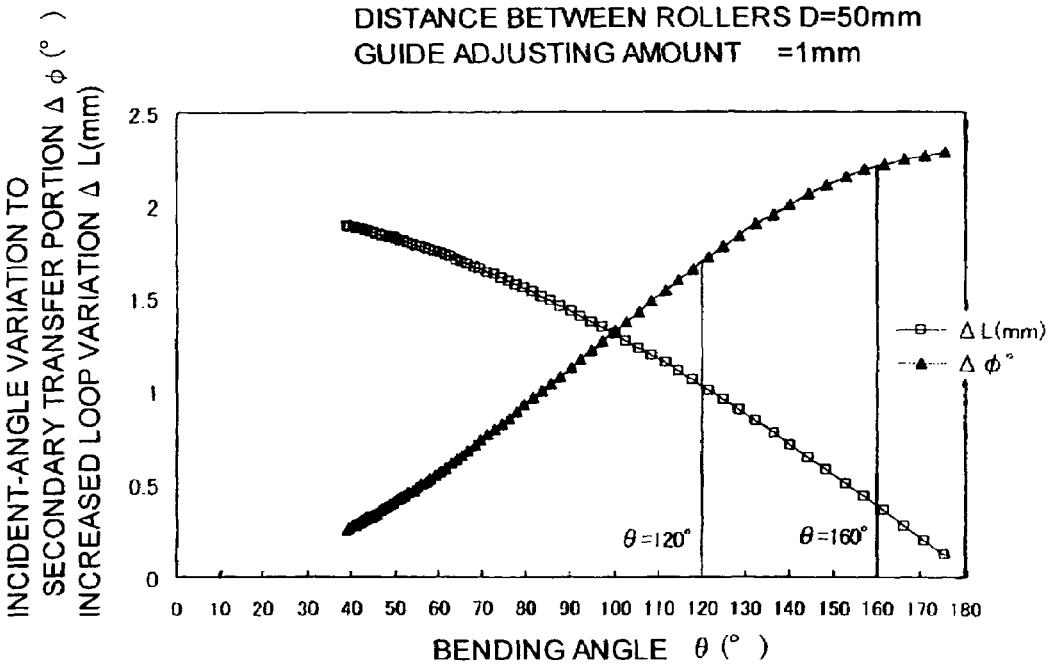
FIG. 6 is a performance graph showing a correlation among a bending angle, an incident-angle variation to a secondary transfer portion and a guide adjusting amount in the first embodiment on condition that a distance between roller axes d=50 mm.

FIG. 6 is a graph showing a correlation among a bending angle θ, a guide path variation ΔL, and an incident-angle variation Δϕ to the secondary transfer portion on condition that, for example, a distance between roller axes d=50 mm, and a guide adjusting amount Y=1 mm. It is clear from the above graph that the smaller bending angle θ causes a guide adjusting efficiency to become better. That is, the guide path length L can be greatly changed by a small guide adjusting amount Y.

Then, when the bending angle θ is equal to, or smaller that, for example, 160 degrees, it is found in the guide configuration than angle variation in the neighborhood of the transfer roller can be reduced because, when the bending angle θ is smaller than about 160 degrees, the inclination of Δϕ to the change in the bending angle θ becomes sharp according to the graph FIG. 6. Accordingly, the angle variation in the neighborhood of the transfer roller of the sheet material S can be reduced even after the guide adjustment. Consequently, a defective image due to air discharge just before entering into a nip portion of the secondary transfer rollers 4 and 5, may be prevented, and an abnormality in an image caused by transfer abnormality may be also prevented.

Moreover, when the bending angle θ is equal to, or smaller than, for example, 120 degrees, it is found according to the graph shown in FIG. 6 that the guide adjusting amount is smaller than the paper adjusting amount when the bending angle θ is smaller than about 120 degrees. Accordingly, the guide adjusting efficiency is much improved.

Though the first secondary transfer feeding guide 1 is moved in the direction (in the direction of the arrow X shown in the drawing) approximately perpendicular to the tangential direction to the ellipsoidal orbit P passing the abutment portion A in the present embodiment, the adjusting direction of the abutment portion A may be set approximately parallel to the straight line AB connecting the nip portion B of the secondary transfer rollers 4 and 5 and the abutment portion A, giving priority to a configuration in which angle variation in the vicinity of the transfer roller can be made smaller. Thereby, there may be provided a guide adjusting mechanism in which angle variation in the vicinity of the transfer roller is controlled, though there may be attended by some sacrifices of the guide adjusting efficiency.

Moreover, generation of front and far-side shift of an image at the tip of the sheet material S, or an abnormal image caused by an abnormality in the image magnification and the like may be prevented according to the present embodiment, because the front and far-side difference of the guide path length L may be efficiently adjusted by adjusting the secondary transfer feeding guide 1 to be slid and moved in the direction approximately perpendicular to the tangential direction to the ellipsoidal orbit P passing the abutment portion A. At the same time, the present invention has an advantage that a defective image due to air discharge just before entering into a nip portion of the secondary transfer rollers 4 and 5, may be prevented, and an abnormality in an image caused by transfer abnormality may be also prevented, because the angle variation in the neighborhood of the transfer roller of the sheet material S can be reduced.

SECOND EXAMPLE

Figure 7:
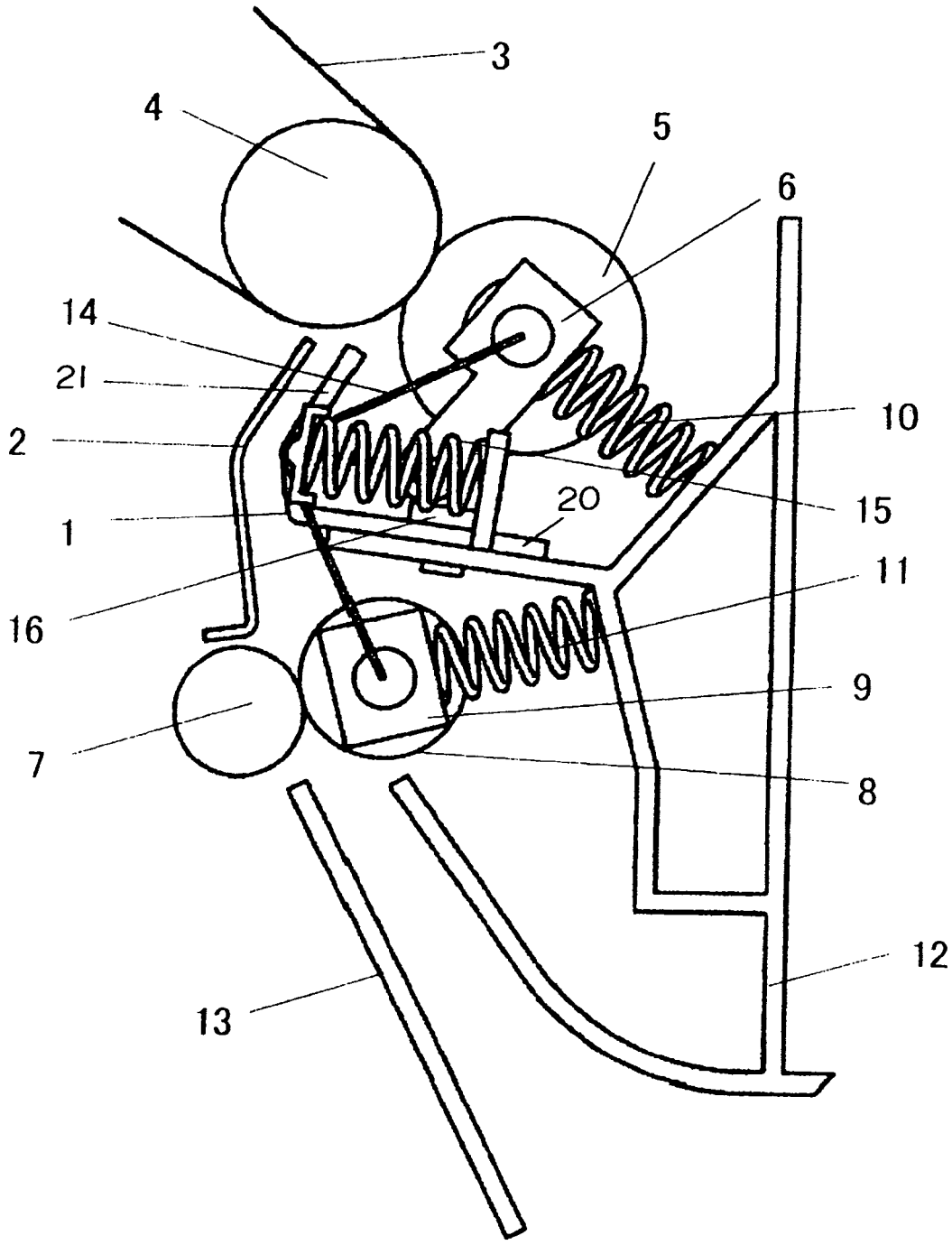
FIG. 7 is a sectional view showing a configuration of a sheet guide path according to a second embodiment of the present invention.

Subsequently, a point of a second embodiment is a configuration in which, as shown in FIG. 7, there is provided path-length adjusting wire (path-length limitation member) by which a distance made by three points of an abutment portion A of a secondary transfer feeding guide 1, a nip portion B of secondary transfer rollers 4 and 5, and a nip portion C of a registration rollers 7 and 8 may be controlled to be kept constant at any time.

That is, referring to FIG. 5, path length adjusting wire 14 is controlled in such a way that a value AB+AC (refer to FIG. 5), which is obtained by adding the line distance AB connecting the abutment portion A and the nip portion B of the secondary transfer rollers 4 and 5 and the line distance AC connecting the abutment portion A and the nip portion C of the registration rollers 7 and 8 is always kept constant. The both ends of the path length adjusting wire 14 are fastened to the rotation axis of the secondary transfer roller 5 and that of the registration roller 8, respectively, and the wire is caught in the middle by the front and far-side portion of the secondary transfer feeding guide 1 without causing interference with passing of the sheet material in such a way that the middle of the wire can be slipped and moved to be displaced. The above-described path-length adjusting wire 14 is tightly stretched with two tension springs 15 under enough tension and without any slack. Thereby, the guide path length L is kept constant with the path length adjusting wire 14.

Moreover, the secondary transfer feeding guide 1 is controlled with a stepped machine screw 16 to move only in the direction (in the direction of the arrow X shown in the drawing) approximately perpendicular to the tangential direction to the ellipsoidal orbit P passing the abutment portion A, wherein the orbit has focal points of the point B and the point C. Thereby, the distance between the axis for the registration rollers 7 and 8 and that for the secondary transfer roller 4 and 5, that is, the guide path length L as a distance between the nips is automatically kept constant, and generation of front and far-side shift of an image at the tip of the sheet material S, or an abnormal image caused by an abnormality in the image magnification and the like may be prevented.

Here, the present invention is not limited to the first and second embodiments described above, and other embodiments or combinations thereof, and variants or applications may be possible without departing from the scope of the present invention.

For example, the first and second embodiments have disclosed a configuration in which fine adjustment of the secondary transfer feeding guide 1 by sliding for moving is manually or automatically executed. On the other hand, another embodiment adopting a configuration in which, when the rotational speeds V1 of the secondary transfer rollers 4 and 5 shown in FIG. 10A are smaller and slower than the rotational speeds V2 of the registration rollers 7 and 8, that is, in the case of V1<V2, the secondary transfer feeding guide 2 can slide and move for adjustment in a sheet conveying system has similar advantages to those of the above-described embodiments, wherein the sheet material S is pressed against the secondary transfer feeding guide 2 in the sheet conveying system.

Moreover, though the first and second embodiments have been explained, assuming that concrete examples of two conveying means of the present invention are the registration rollers 7 and 8 and the secondary transfer rollers 4 and 5, even a combination of the registration rollers 7 and 8 and the fixing roller (not shown in the drawing), instead of the combination of the registration rollers 7 and 8 and the secondary transfer rollers 4 and 5, is also effective for the present invention.

This application claims the benefit of priority from the prior Japanese Patent Application No. 2005-146528 filed on May 19, 2005 the entire contents of which are incorporated by reference herein.

What is claimed is:

1. An image forming apparatus, including:

a first sheet conveying member arranged on an upstream side of a sheet conveying path;

a second sheet conveying member arranged on a downstream side of said sheet conveying path;

a guide member which is provided between said first and said second sheet conveying members and guides a sheet material conveyed from said first sheet conveying member to said second sheet conveying member;

a movable portion which is movably provided in said guide member, wherein said movable portion has an abutment portion against which the sheet material conveyed toward to said second sheet conveying member by said first sheet conveying member is abutted, and said abutment portion is adjusted by movement of said movable portion so that the tip of the sheet material guided by said guide member is in parallel to a sheet width direction perpendicular to a conveying direction, and a path-length limitation member limiting an added value within a preset value, wherein a movement direction of said abutment portion by a movement of said movable portion is a direction perpendicular to a tangential line to an ellipsoidal orbit which said abutment portion passes, it is assumed that each of the nip portions of said first and said second sheet conveying members is one of two focal points for an ellipsoidal orbit, wherein said added value is obtained by adding a straight line distance connecting said abutment portion in said movable portion and said first sheet conveying member to a straight line distance connecting said abutment portion and said second sheet conveying member, wherein said path-length limitation member is shaped like wire, and the both ends of the wire are fastened to the rotation axes of said first and said second sheet conveying members, respectively, and the wire is caught in the middle by a location in said movable portion without causing interference with said abutment point in said movable portion in such a way that the middle of the wire can be displaced.

2. The image forming apparatus according to claim 1, wherein said first sheet conveying member is one pair of registration rollers which are on the upstream side and are facing with each other, and said second sheet conveying member is one pair of secondary transfer rollers which are on the downstream side and are facing with each other.

3. The image forming apparatus according to claim 1, wherein said first sheet conveying member is one pair of transfer means which are on the upstream side and are facing with each other, and said second sheet conveying member is one pair of fixing means which are on the downstream side and are facing with each other.

4. The image forming apparatus according to claim 1, having a configuration in which a conveying speed of said sheet material conveyed by said second sheet conveying member is slower than that of said sheet material conveyed by said first sheet conveying member.

5. The image forming apparatus according to claim 1, having a configuration in which an image formation device transfers images born on an image bearing member onto an intermediate transfer belt, and said transferred images are transferred onto said sheet material conveyed to a pair of secondary transfer rollers.

* * * * *